US005781207A

United States Patent [19]

Hasegawa et al.

[11] Patent Number: 5,781,207

[45] Date of Patent: Jul. 14, 1998

[54] INK JET RECORDING APPARATUS

[75] Inventors: Koh Hasegawa; Noriyuki Kikugawa, both of Yokohama, Japan

[73] Assignee: Canon Kabushiki Kaisha, Tokyo, Japan

[21] Appl. No.: 948,047

[22] Filed: Oct. 9, 1997

Related U.S. Application Data

[63] Continuation of Ser. No. 800,766, Feb. 13, 1997, abandoned, which is a continuation of Ser. No. 111,586, Aug. 25, 1993, abandoned, and a continuation of Ser. No. 707,783, May 30, 1991, abandoned.

[30] Foreign Application Priority Data

Jun. 1, 1990 [JP] Japan ..... 2-144609

[51] Int. Cl.[6] ..... B41J 2/165

[52] U.S. Cl. ..... 347/23; 347/5; 400/54; 400/61

[58] Field of Search ..... 347/5, 22, 23, 347/29; 400/54, 61, 77

[56] References Cited

U.S. PATENT DOCUMENTS

| | | | |
|---|---|---|---|
| 4,176,363 | 11/1979 | Kasahara | 347/19 |
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,332 | 12/1985 | Takahashi | 347/14 |
| 4,558,333 | 12/1985 | Sugitani et al. | 347/65 |
| 4,723,129 | 2/1988 | Endo et al. | 347/56 |
| 4,740,796 | 4/1988 | Endo et al. | 347/56 |
| 4,804,278 | 2/1989 | Gotou et al. | 400/54 |
| 4,898,483 | 2/1990 | Iizuka | 400/61 |
| 4,967,204 | 10/1990 | Terasawa et al. | 347/23 |
| 5,164,748 | 11/1992 | Katayanagi et al. | 347/30 |
| 5,339,098 | 8/1994 | Nagatomo et al. | 347/5 |
| 5,459,496 | 10/1995 | Hanabusa et al. | 347/5 |

FOREIGN PATENT DOCUMENTS

| | | | |
|---|---|---|---|
| 0313204 | 4/1989 | European Pat. Off. . | |
| 3633239 | 4/1987 | Germany . | |
| 0080066 | 5/1982 | Japan | 400/61 |
| 58-181655 | 10/1983 | Japan . | |
| 59-123670 | 7/1984 | Japan . | |
| 59-138461 | 8/1984 | Japan . | |
| 61-146560 | 7/1986 | Japan | 347/5 |

*Primary Examiner*—N. Le
*Assistant Examiner*—Charlene Dickens
*Attorney, Agent, or Firm*—Fitzpatrick, Cella, Harper & Scinto

[57] ABSTRACT

An ink jet recording apparatus comprises input keys for inputting information to be recorded, a protection device for protecting a recording head for discharging ink to record onto a recording medium in accordance with the input keys, and an execution controller for carrying out the protection of the recording head with the protection device by deciding whether a predetermined period has passed, after input by the input keys.

50 Claims, 7 Drawing Sheets

INK JET RECORDING APPARATUS

This application is a continuation of application Ser. No. 08/800,766 filed Feb. 13, 1997, now abandoned, which is a continuation of application Ser. No. 08/111,586 filed Aug. 25, 1993, abandoned, which is a continuation of application Ser. No. 07/707,783 filed May 30, 1991, abandoned.

BACKGROUND OF THE INVENTION

1. Field of the Invention The present invention relates to an ink jet recording apparatus, and more particularly to an ink jet recording apparatus having a key input device.

2. Related Background Art

Conventionally, the recording apparatus for recording onto a recording medium such as a paper or OHP sheet (hereafter referred to as a recording sheet or simply as a paper) mounted on the electronic typewriter has been proposed in the form of mounting a recording head in accordance with various recording methods. There are such recording heads based on wire-dot, thermal, thermal imprint and ink jet recording methods.

Particularly, the ink jet recording method is one of directly discharging ink onto a recording sheet, and has been noted by virtue of its inexpensive running cost and quiet recording. Generally, in the typewriter, the processing for determining the layout for printing such as settings of left and right margins or tab can be performed by setting the recording head at an arbitrary position while moving it relative to a recording sheet.

However, if it takes some time to conduct such processing, discharge ports of the ink jet recording head are exposed to the outside air without being driven, whereby there is a fear that the ink solvent will evaporate from the discharge ports to cause the ink within the discharge ports to be thickened.

Also, in addition to the above problem arising initially at the start of using a typewriter, there are some problems that occur during actual recording as will be discussed below.

That is, in the word processor mode for performing the batch print mode of document, when any new recording signal is not input to the recording head after recording, the recording head may be capped after passage of a predetermined period. However, in the typewriter mode for performing the print mode in a unit of character or line, there is a problem that if the capping operation in the above word processor mode is directly applied, the capping operation may be repeated at improper timings.

SUMMARY OF THE INVENTION

An object of the present invention is to provide a recording apparatus with improved operativity in which the through-put of recording (total processing time from key input to termination of recording) can be shortened and the operator can accomplish the recording without inconvenience to thereby resolve the above conventional technical problems.

Another object of the present invention is to provide a recording apparatus capable of selecting the recording form of word processor mode and typewriter mode, and with improved operativity in either of cases.

Another object of the present invention is to provide an ink jet recording apparatus comprising key input means for inputting the information, protection means for protecting a recording head for discharging ink to record onto a recording medium in accordance with said key input means, and execution means for carrying out the protection of said recording head with said protection means by deciding whether or not a predetermined period has passed after key input from said key input means.

Another object of the present invention is to provide a recording apparatus capable of automatically capping a recording head when the recording apparatus is stored.

DETAILED DESCRIPTION OF PREFERRED EMBODIMENTS

An example of the present invention will be described in detail with reference to the drawings.

Figure 1A:
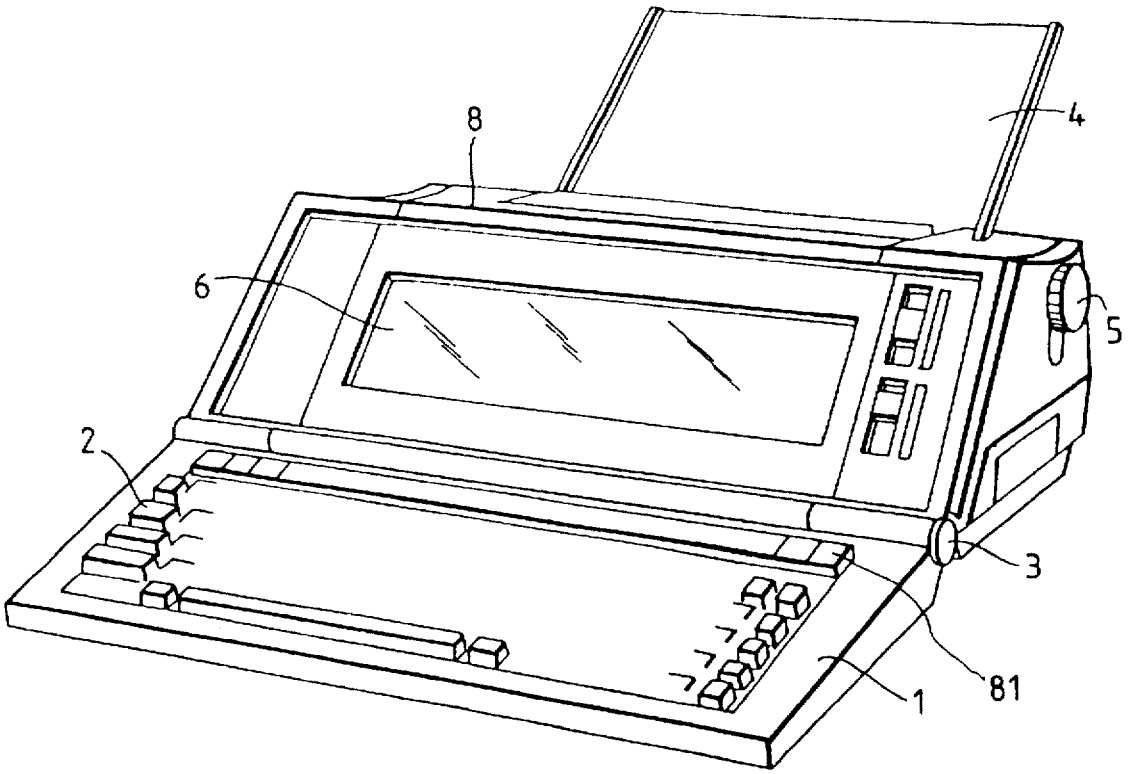
FIGS. 1A and 1B are external perspective views of an electronic typewriter as the apparatus in an example of the present invention, when in use and storage, respectively.
Figure 1B:
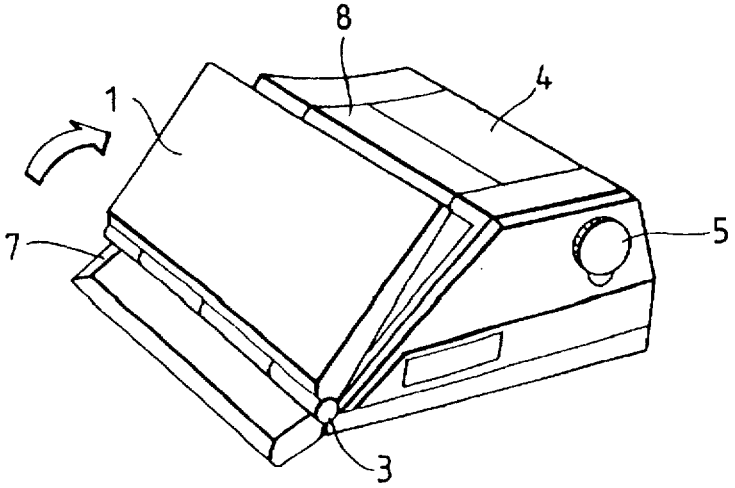

FIGS. 1A and 1B show perspective views of an electronic typewriter as the apparatus to which this invention is applicable.

Here, 1 is a keyboard section in which is arranged a group of keys 2, such as keys for entering characters, e.g. letters and numerals, a print command key, e.g. return key, control keys, and a WP/TW switch key for switching between a word processor mode and a typewriter mode as will be described later. When not used, the keyboard section 1 can be folded by turning it around a hinge 3, as shown in FIG. 1B. Numeral 4 is a paper feed tray for feeding a sheet-like recording medium laid thereon to a printer section within the apparatus, and can be also stored by folding over the printer section, as shown in FIG. 1B, when not used. Numeral 5 is a feeder knob for setting the recording medium at a recording position or exhausting it therefrom manually, wherein the feeder knob is used to convey the recording medium in an exhausting direction or opposite direction by the operator turning it manually in a clockwise or counterclock-wise direction, 6 is a display for displaying texts input by the key operation or from floppy disk, and 7 is a handle used to transport the apparatus of this example.

Figure 2:
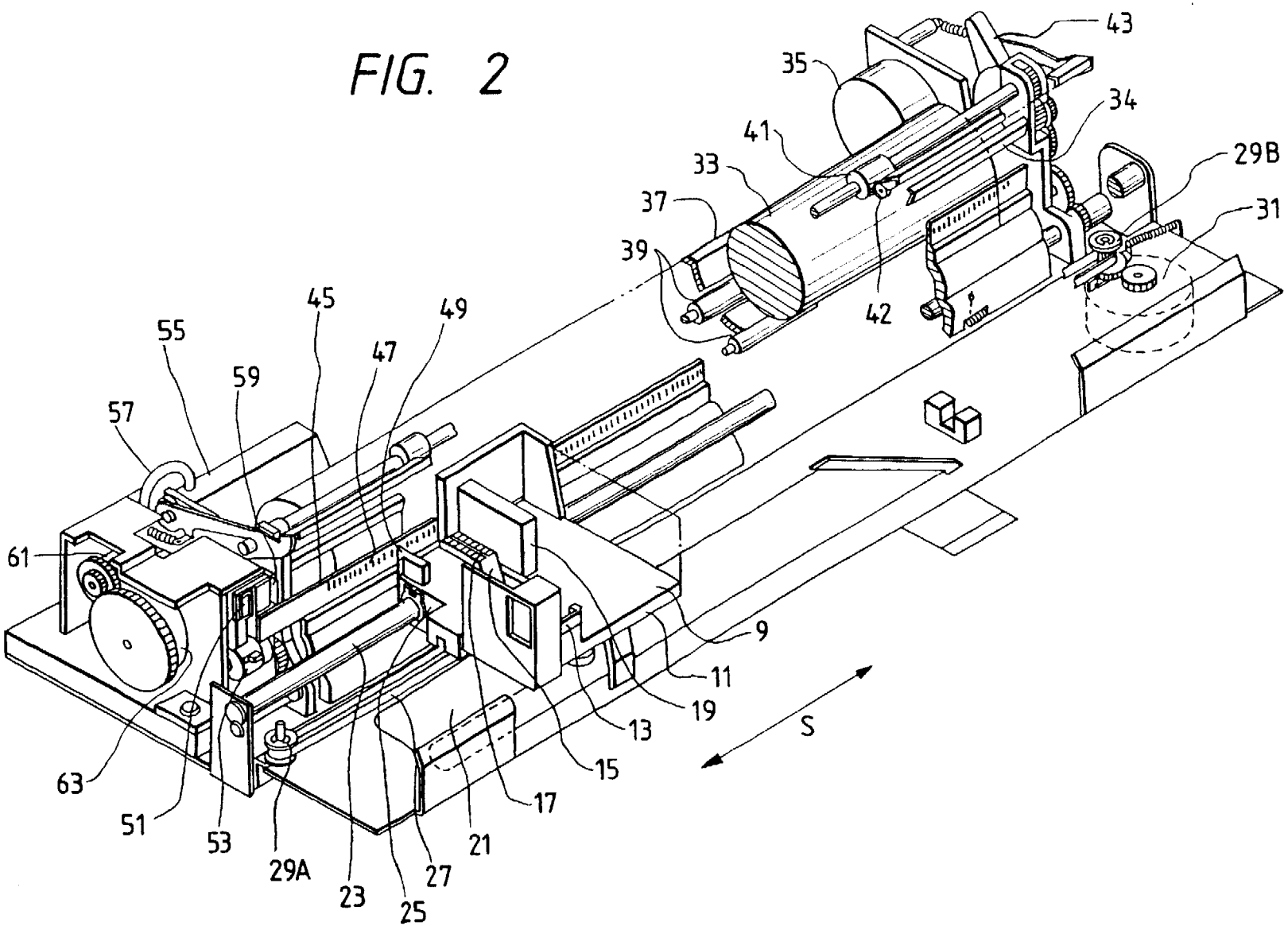
FIG. 2 is a perspective view showing one constitutional example of a printer which is applicable in an example according to the present invention.

FIG. 2 shows a construction of a printer section of this example.

Here, 9 is a head cartridge having an ink jet recording head, which is loaded detachably onto a carriage 11, and the carriage 11 with the head cartridge 9 mounted thereon can perform the scanning operation in the S direction as indicated in the figure (or reciprocate transversely to a conveying passage of recording medium). Numeral 13 is a hook for mounting the head cartridge 9 onto the carriage 11, and 15 is a lever for operating the hook 13. On this lever 15 is provided a marker 17 for enabling a print or set position of the recording head in the head cartridge to be read with the indication of a scale provided on a cover as will be described later. Numeral 19 is a support plate for supporting an electrical connection section (not shown) to the head cartridge 9. Numeral 21 is a flexible cable for connecting between its electrical connection section and a control section of main body.

Numeral 23 is a guide shaft for guiding the carriage 11 in the S direction, which is inserted through bearings 25 of the carriage 11. Numeral 27 is a timing belt for transmitting the power to move the carriage 11 fixed thereto in the S direction, looped under tension about pulleys 29A, 29B disposed on both side portions of the apparatus. A driving force is transmitted to one pulley 29B via a transmission device, e.g. a gear, by a carriage motor 31.

Numeral 33 is a conveying roller for conveying recording medium, e.g. a paper (thereafter referred to as a recording paper) in recording, as well as regulating a record plane of the recording medium, and which is driven by a conveying motor 35. Numeral 37 is a paper pan for conducting recording medium from the paper feed tray 4 to a recording position. Numeral 39 is a feed roller, disposed on a way of conveyance path for recording medium, for conveying the recording medium pressed against the conveying roller 33. Numeral 34 is a platen for regulating a recording face of recording medium, opposed to a discharge port formation face of the head cartridge 9. Numeral 41 is a paper exhausting roller for exhausting recording medium to a paper exhausting port, not shown, which is disposed downstream from recording position in the direction of conveying recording medium. Numeral 42 is a spur provided correspondingly to the paper exhausing roller 41, for pressing the roller 41 via recording medium, and developing a force for conveying the recording medium with the paper exhausing roller 41. Numeral 43 is a release lever for releasing the engagement between a feed roller 39, a presser bar 45 and a spur 42 in setting a recording medium, which is manipulable by the operator.

Numeral 45 is a presser bar for suppressing the floating of a recording medium in the neighborhood of a recording position to secure a close contact state against the conveying roller 33. In this embodiment, an ink jet recording head for recording with the discharge of ink is used as the recording head.

Accordingly, as the distance between the ink discharge port formation face of recording head and a record surface of recording medium is relatively slight, and must be strictly controlled to avoid a contact between the recording medium and the discharge port formation face of head, it is effective to press the recording medium against the conveying roller 33 by means of the presser bar 45. Numeral 47 is a scale provided on the presser bar 45, and 49 is a marker provided on the carriage 11 correspondingly to this scale, both of them being used to enable a print or set position for the recording head to be read.

Numeral 51 is a cap made of an elastic material, e.g. rubber, which is opposed to the ink discharge port formation face of recording head placed at a home position, and supported so as to easily attach to/detach from the recording head. The cap 51 is used for protecting the recording head when not used, or in a suction recovery processing for the recording head. It should be noted that the suction recovery process is one of removing discharge faulty factors with the ink forcedly discharged from the whole discharge ports, by driving energy generation elements provided inwardly of ink discharge ports and generating the energy used for discharging ink.

Numeral 53 is a pump used to exert a suction force for the forced discharge of ink, and to suck the ink received within the cap 51 in the suction recovery process with the forced discharge of ink. Numeral 55 is a waste ink tank for reserving waste ink sucked by the pump 53, and 57 is a tube communicating between the pump 53 and the waste ink tank 55.

Numeral 59 is a blade for wiping the discharge port formation face of the recording head. This blade 59 is held to be movable between a position for wiping with the movement of head which projects onto the recording head, and a retracted position not engaging the discharge port formation face. Numeral 61 is a motor, and 63 is a cam mechanism for driving the pump 53 and moving the cap 51 and the blade 59, with the power transmitted from the motor 61.

Figure 3:
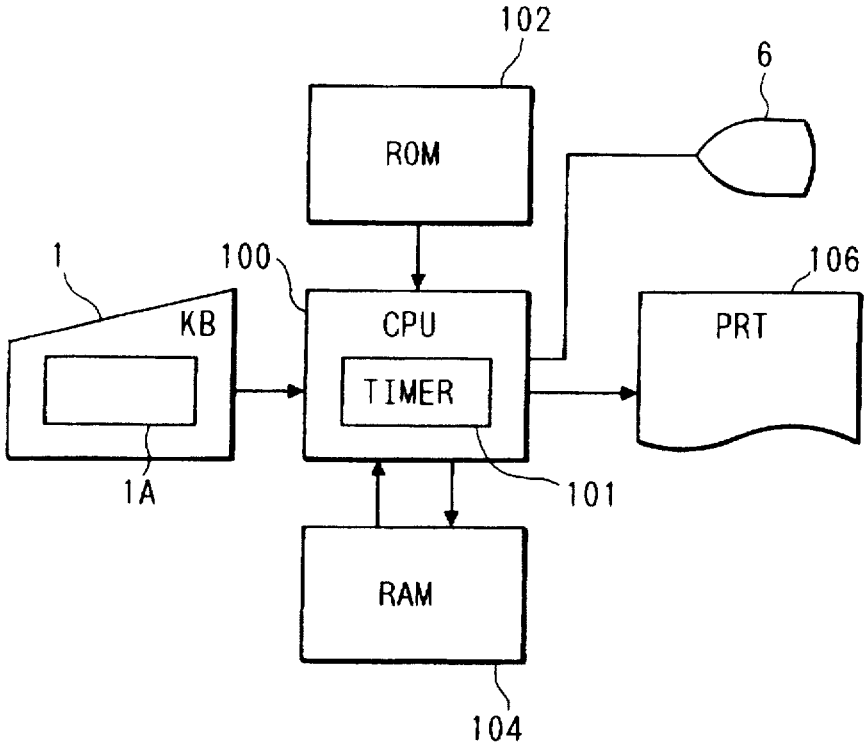
FIG. 3 is a block diagram showing a schematic constitutional example of a control system in the electronic typewriter according to the present example.

FIG. 3 shows a schematic constitutional diagram of the controls in an electronic typewriter of an example according to the present invention.

To begin with, on the keyboard section 1 is arranged a WP/TW change-over key 81 for switching between word processor mode and typewriter mode. Note that the word processor mode is a mode in which document is printed in batch, while the typewriter mode is a mode in which it is printed in a unit of character or line.

Numeral 100 is a CPU, for example, in the form of a microcomputer, for controlling each section in accordance with processing procedures as will be described later in FIG. 5. Numeral 101 is a timer provided on the CPU 100 to be used for measuring the time during which there is no key input, and controlling the printer, the explanation of which is omitted herein.

Numeral 102 is a ROM for storing fixed data such as a character generator, as well as programs corresponding to the processing procedures executed by the CPU 100. Numeral 104 is a RAM having the working area for the CPU 100, in addition to the areas for development and management of data in printing. Numeral 106 is an ink jet printer as described in FIG. 2.

Essential parts of the example according to the present invention will be now described with reference to FIGS. 4 and 6.

Figure 4:
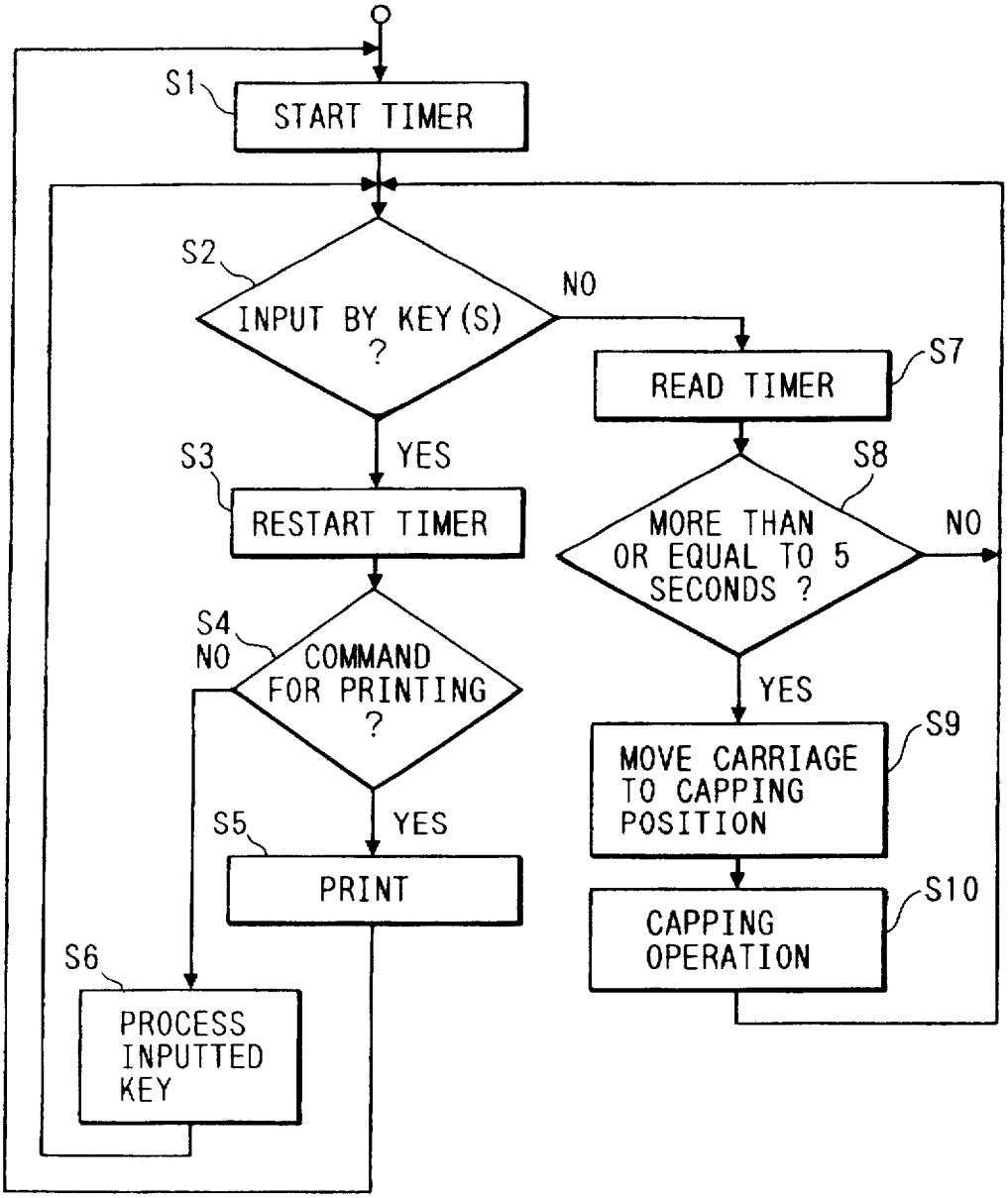
FIG. 4 is a flowchart showing an embodiment of procedure for capping when there is no key input for a predetermined period.

A flowchart of FIG. 4 illustrates an embodiment of print processing procedure in this example, which is activated after termination of print operation.

If this procedure is started, firstly the timer 101 is started at step S1. Next, at step S2, the procedure waits for input by key, and if there is input by key, the timer 101 (which has been started at step S1) is restarted again at step S3, and then the decision of input key is made at step S4. If the input key involves a command for printing, printing is performed at step S5, and then the procedure returns to step Sl. If input key does not involve any print operation, the process of input key such as displaying input key is performed at step S6, and then the procedure returns to step S2.

In the processes as above described, the timer 101 is only restarted, and the recording head is not capped.

However, if there is no input by key at step S2, the CPU 100 reads a value of the timer started at step Sl or S3 into the RAM 104 (step S7), a decision is made whether or not more than or equal to 5 seconds have passed (step S8). Here, if more than or equal to 5 seconds have not passed, the procedure waits for input by key at step S2. And only if more than or equal to 5 seconds have passed, the carriage 11 is moved to a capping position at step S9, the capping operation is performed at step S10, and then the procedure returns to step S2. Note that steps S9 and S10 are skipped if the carriage 11 has been already positioned at the capping position and capped.

The above-mentioned input by key may be sufficient with one by which the CPU 100 can judge whether or not the operator is using the apparatus. Accordingly, any key from the key input facility is applicable to this decision process. This constitution is effective when the apparatus is stored, because if there is no input by key for a predetermined period, the CPU 100 determines the termination of apparatus in use, thereby performing the capping. Thus, it is especially effective in that when the recording apparatus is stored, the apparatus is necessarily placed in the capped state.

As above described, according to the present invention, when key input signal has been interrupted for fixed period, the ink jet recording head is capped for protection from the outside, so that there is no exposure of the recording head to the atmosphere without being driven for a long time while the apparatus is not used, and therefore, degradation of print quality or discharge failure will not occur owing to increased viscosity of ink inward of discharge ports. Also, when the operator is actually operating the apparatus, the above-mentioned predetermined time (five seconds in the above example, or preferably from three to eight seconds) is taken as key input interval time which is average in normal use when the typewriter feature is used. Accordingly, it is prevented that the capping is made carelessly with the carriage 11 moved while the apparatus is used, so that unpreferable state in operation can be essentially eliminated, and it is also possible to read and confirm the print position.

Figure 6:
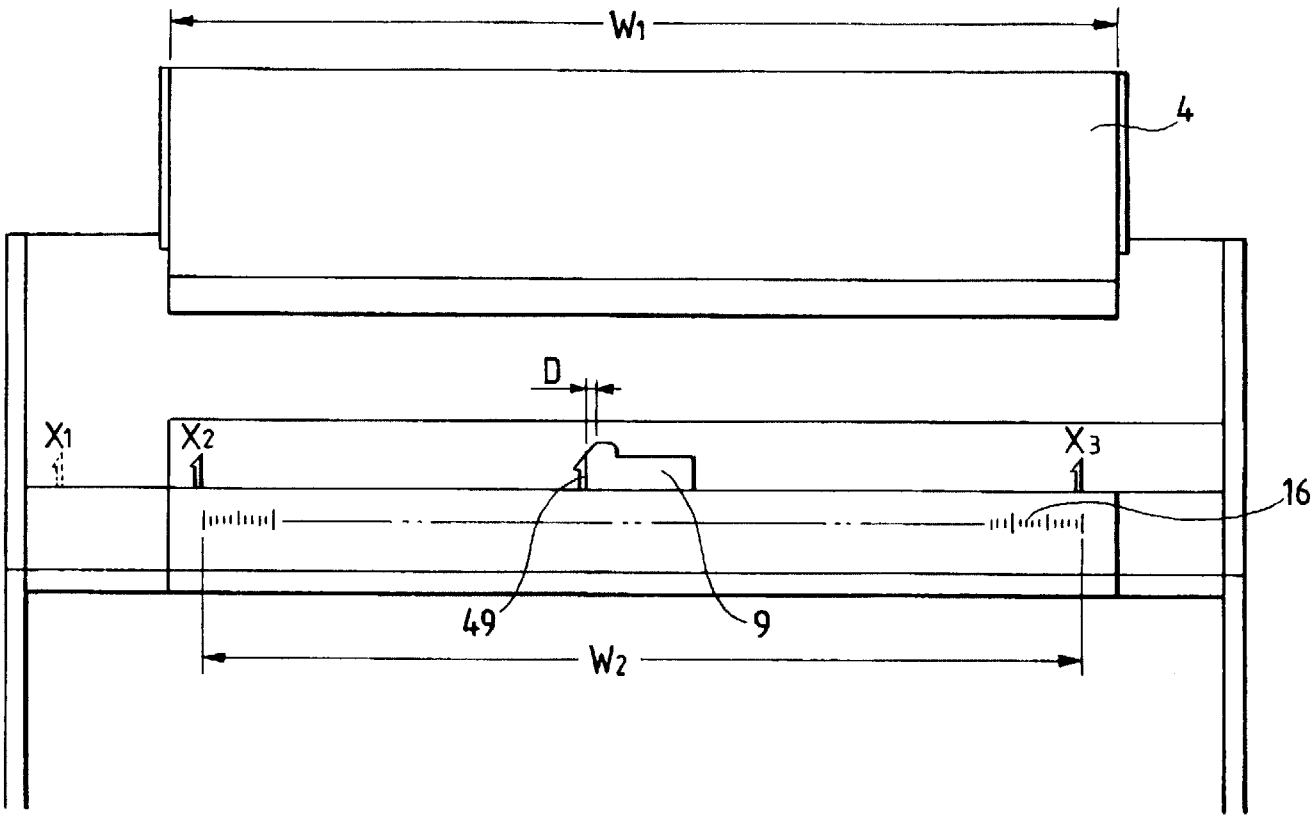
FIG. 6 is an explanation view showing an essential part of a constitution of an apparatus which is applicable in an embodiment to the present invention.

Referring now to FIG. 6, the movement state of carriage 11 will be described. In the word processor mode, the carriage 11 causes the recording head cartridge 8 to be positioned at the capping position $X_1$, and only starts to move to a start position $X_2$ in print mode with a print signal. Further, the carriage 11 is positioned at the above-mentioned capping position $X_1$ in the typewriter mode, but starts to move to the start position $X_2$ with a first print of predetermined unit (word, line or page). Then, the carriage 11 returns after termination of print in predetermined unit to stop the recording head cartridge 8 at the start position $X_2$ and wait for creation of texts with key input by the operator.

Hereby, for the key input by the operator, the sequence control is performed based on the flow-chart as shown in FIG. 4, in which the interval for decision as above mentioned is reset every time the key input is made by the operator.

FIG. 6 shows a schematic explanation view from above of an electronic typewriter of this example. $W_1$ indicates an insertable range of recording medium, and $W_2$ indicates the maximum print width. $X_1$ indicates a home position, which is also used to make the capping. $X_2$ indicates a leftmost position for printing, and $X_3$ indicates a rightmost position in returning. D indicates the distance between the marker 17 and the ink discharge ports of recording head.

Numeral 16 is a scale corresponding to the marker 17 as above, for permitting the reading of print or setting position with the recording head of head cartridge 9.

As described, this example is constituted in such a way that the recording head unit can move up to the area at the rightmost position $X_3$ which corresponds to the maximum recording width for recording sheet. And as this position is defined as the rightmost portion for the return area of head, the head can not be moved to a side area therefrom. Accordingly, in the side area, an ink tank portion of head cartridge only exists, whereby it is possible to shorten the length of the recording apparatus in a width direction of recording sheet.

Figure 5:
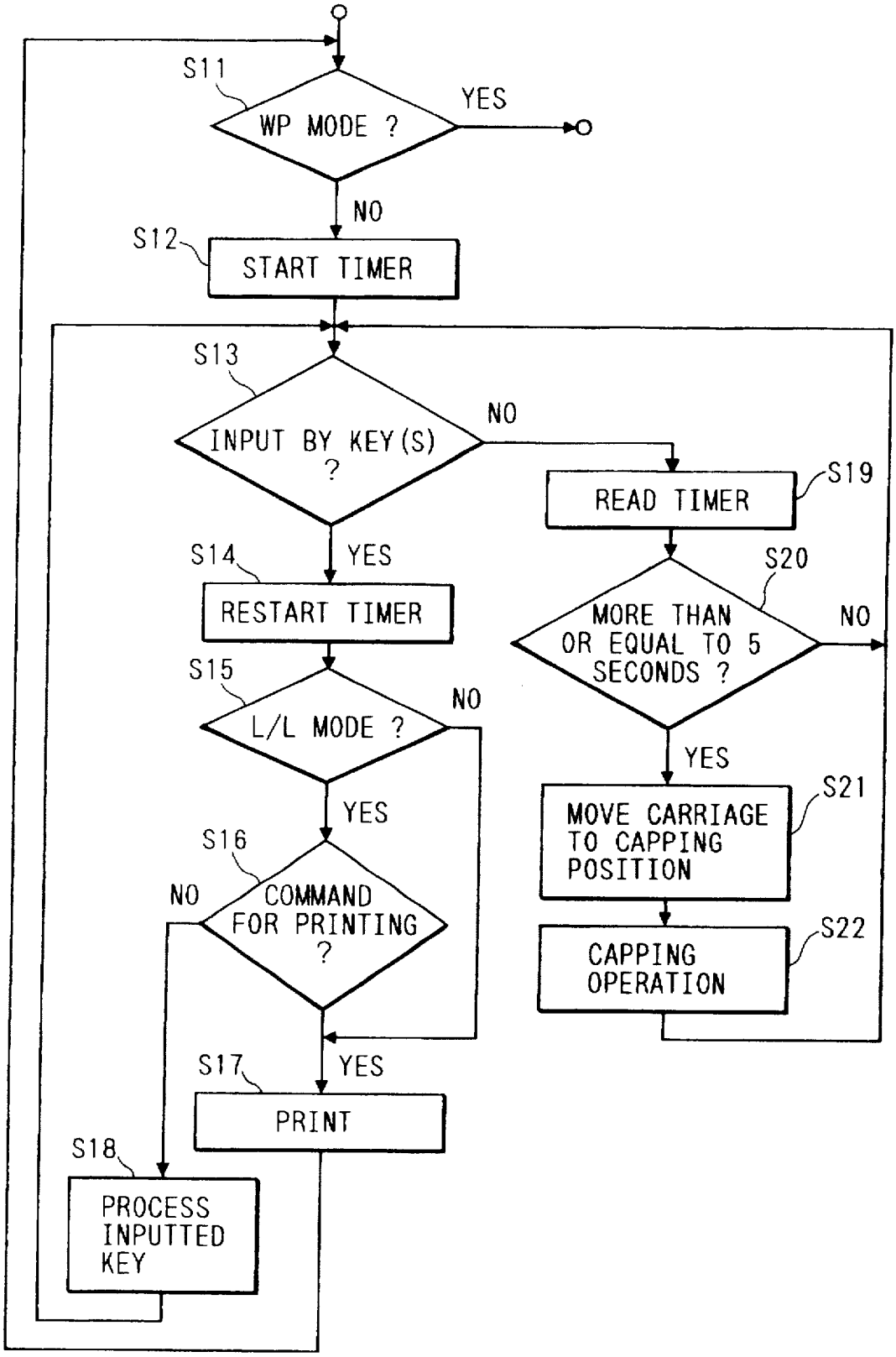
FIG. 5 is a flowchart showing an essential portion of when WP and TW modes are provided, according to another embodiment.

FIG. 5 shows another embodiment of a print processing procedure in this example, which is activated after termination of print operation.

If the present procedure is started, firstly, a determination is made at step S11 whether the mode is a word processor mode (hereafter referred to as WP mode) or a typewriter mode (hereafter referred to as TW mode). If in TW mode, the procedure proceeds to a next step S12, while if in WP mode, this procedure is not started and the ordinary processing is performed (the explanation is omitted). Next, the timer 101 is started at step S12, and then at step S13, the procedure waits for input by key. If there is input by key, the timer 101 (which has been started at step S12) is restarted at step S14, and then the procedure proceeds to step S15. At step S15, a determination is made whether the mode is a line by line mode for printing per line (thereafter referred to as L/L mode) or a character character mode (thereafter referred to as C/C mode) for printing per character. If in C/C mode, the procedure skips the next step S16 and proceeds to step S17, where printing is performed. If in L/L mode, at step S16, a determination is made whether or not input key is a key involving print such as the return key, in which if not involving the print, a process such as displaying input key is performed (step S18), and the procedure returns to step S13, while if involving the print, the print is performed at step S17, and the procedure returns to step S11.

In the processes as above described, the timer 101 is only restarted, and the recording head is not capped.

However, only if there is no input by key at step S13, a value of the timer started at step S12 or S14 (step S19) is read, and a decision is made whether or not a predetermined time (e.g. five seconds) has passed (step S20). Herein, if 5 seconds have not passed, the procedure waits for input by key at step S13, and if 5 seconds have passed, the carriage 11 is moved to a capping position at step S21, the capping operation is performed at step S22, and then the procedure returns to step S13. Note that steps S21 and S22 are skipped if the carriage 11 has been already positioned at the capping position and capped.

As above described, in this example capable of both WP and TW modes, the same effects can be obtained as those in the embodiment as shown in the flowchart of FIG. 4, and further the operativity of the operator in WP mode can be improved, so that it is possible to provide a complex printer with improved throughput in the processing time from input by key to termination of recording.

In the previous embodiment as shown in FIGS. 4 and 5, the recording head is capped when there is no input by key for a predetermined period (e.g. five seconds).

Figure 7:
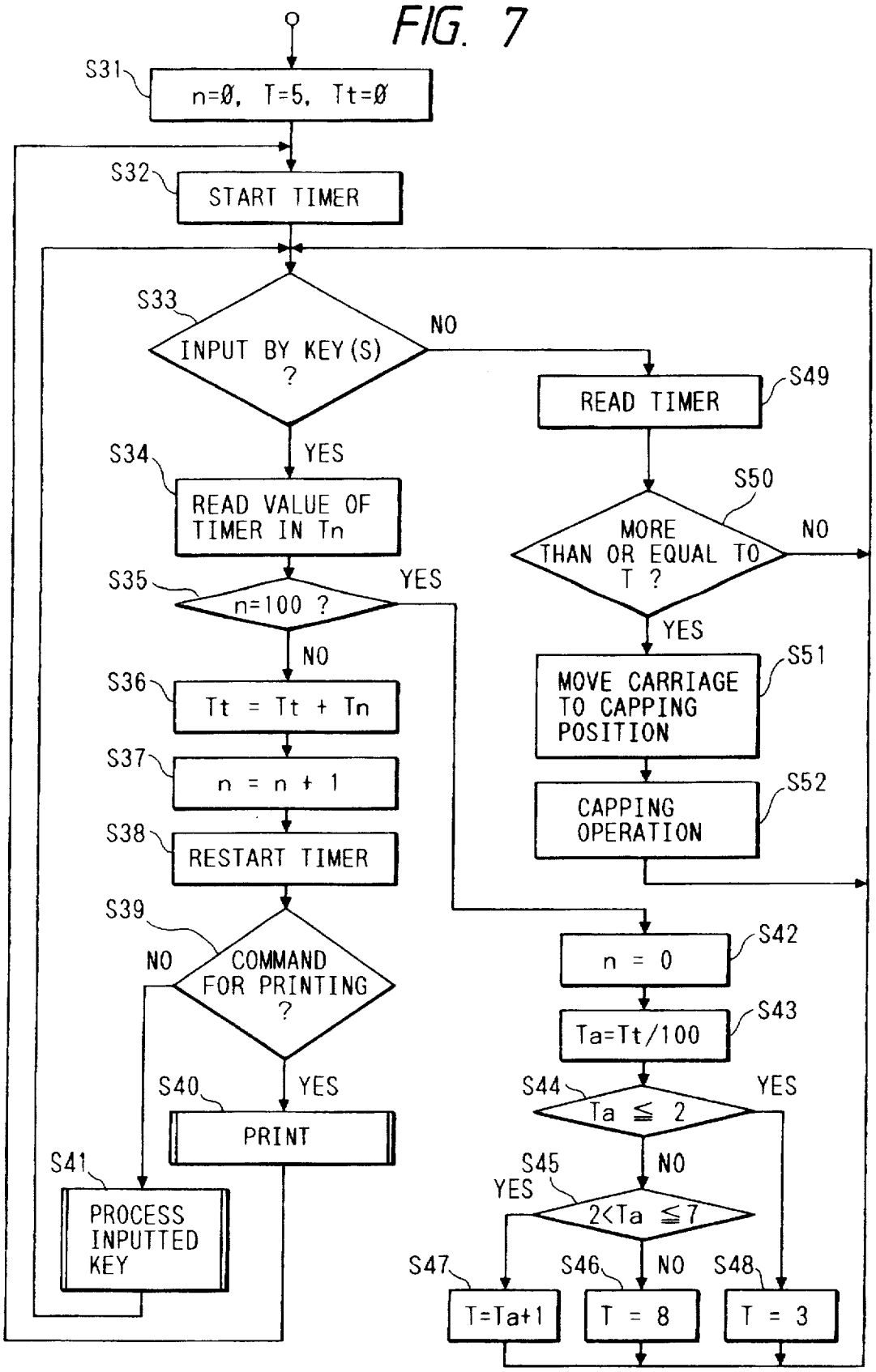
FIG. 7 is a flowchart showing another embodiment of procedure for capping when there is no key input for a predetermined period.

On the contrary, in FIG. 7, another embodiment is shown in which the predetermined period is changed within a fixed range of time (e.g. from three seconds to eight seconds) depending on the degree of skill in the speed of key input by the operator.

If the procedure according to a flowchart as shown in FIG. 7 is started, firstly, at step S31, n and $T_r$, which will be used later, are initialized to be zero, and further, a standard default value of 5 (seconds) is written to T.

Then, at step S32, the timer 101 is started, then the procedure waits for input by key, and if there is input by key, the value of timer 101 at the time of input by key is read into Tn, at step S34. Next, at step S35, a determination is made whether or not the number of inputs by keys reaches 100, and if not, the procedure proceeds to step S36 where the summation of Tn is obtained as Tt. Next, the value of n is incremented by 1 at step S37, the timer 101 (which has been started at step S32) is restarted at step S38, and then a decision of input by key is made at step S39. If input key involves a command for printing, the print operation is performed at step S40, and then the procedure returns to step S32. If input key does not involve print operation, a process such as displaying input key is performed at step S41, and then the procedure returns to step S33.

In the above processes, the CPU 100 measures the time from the start of timer 101 to input by key, or from the restart of timer 101 to input by key, to calculate the sum of elapsed time while counting the number of times that inputs by keys are made, during which the capping operation is not performed.

However, if there is no input by key at step S33, firstly, the value of timer 101 started at step S32 or S38 is read (step S49), and then a determination is made whether or not a fixed time (herein T=5 seconds which has been written at step S31) has passed (step S50). Here, if 5 seconds has not passed, the carriage 11 is moved to a capping position at step S51, the capping operation is performed at step S52, and then the procedure returns to step S33. Note that steps S51 and S52 are skipped when the carriage 11 has been already located at the capping position and capped.

Next, the setting of elapsed time T will be explained.

In the steps S31 to S41 as previously described, the CPU 100 measures the time up to input by key to calculate the total sum of the time, while counting the number of times n that inputs by keys are made.

However, when the value of n reaches a predetermined number of times that inputs by keys are made (herein n=100 but another integer can be used), the procedure proceeds from step S35 to step S42, in which the number of inputs by keys is reset, and at step S43, the sum of time for 100 inputs by keys calculated at step S36 is divided by 100 to obtain the average time Ta for input by key.

Next, proceeding to step S44, if $Ta \leqq 2$ (seconds), the procedure goes to step S48, where T=3 (seconds) is written as the value of T. At step S45, if $2 < Ta \leqq 7$ (seconds), the procedure goes to step S47, where T=Ta+1 (seconds) is written as the value of T ($3 < Ta \leqq 8$). Further, if $7 < Ta$ (seconds), the procedure goes to step S46, where T=8 (seconds) is written as the value of T. Then, the procedure returns to step S33.

Afterwards, if there is no input by key at step S33, the procedure proceeds to step S50. In this step S50, the value of T written at step S31 is rewritten with a value of T as previous described, and so it follows that if it is more than or equal to that value of T, the capping operation is performed as previously described.

That is, after the procedure in the flowchart as shown in FIG. 7 is started, the CPU 100 determines whether or not the capping operation is performed, using T=5 seconds written at step S31 for up to 100 inputs by keys, and after 101 times, the above determination is made using a time T (seconds) in accordance with the time of input by key for previous 100 times. It should be noted that the value of T is rewritten with a new value for every 100 inputs by keys.

The operations of steps S36 to S38 will be now explained.

The waiting time T for the head to go to the capping is preferably 3 to 8 seconds because thickening of ink should be avoided inward of discharge ports of the ink jet recording head or from the viewpoint of the degree of skill for the user (if it is too short, the capping operation may be unfavorably started in slight interval of input time, whereas if it is too long, the quality of print may be deteriorated due to drying of ink.) Therefore, when the operator is skilled in the operation of typewriter and can input by key very smoothly, for example, in this embodiment, for the operator whose average input time for 100 inputs by keys is 2 seconds or less, the time of 3 seconds is set, because if the capping operation is performed at an average key input time Ta, the number of capping times is unduly increased. Thus, in this example, for the operator having Ta of 2 to 7 seconds, an average time +1 second is set, i.e., for the operator having three seconds, the time of four seconds is set, and further, for the operator having Ta of seven seconds, the time of eight seconds is set. Also, for the operator having Ta of 7 seconds or more, the time of eight seconds is set.

As above described, according to the embodiment as shown in FIG. 7, an optimal capping time is set depending on the operational ability of the operator. Accordingly, the skilled operator capable of rapid input by key can be provided with an apparatus in which unnecessary capping operations are suppressed to a minimum required number of times, and when there is no input by key, the capping operation is started after passage of a predetermined time, whereby the performance of ink jet recording apparatus can be sufficiently exhibited. Also, the operator with slow input by key can be provided with an apparatus having improved operativity without losing the quality of recording with the ink jet recording apparatus.

It should be noted that the method of measuring the predetermined time after completion of input by key is such that the number of clock pulses output by the timer within the CPU is measured, or the predetermined time is measured based on the time signal output by the timer provided outside of the CPU.

Also, the period after completion of input by key is one between inputs by keys, or one as required for predetermined number of a plurality of inputs by keys.

The present invention brings about excellent effects particularly in a recording head or a recording device of the ink jet system for recording by forming minute liquid droplets with the heat energy among the various ink jet recording systems.

As to its representative constitution and principle, for example, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal which gives rapid temperature elevation exceeding nucleate boiling corresponding to the recording information on electricity-heat converters arranged corresponding to the sheets or liquid channels holding a liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into pulse shapes, growth and shrinkage of the bubble can be effected instantly and adequately to accomplish more preferably discharging of the liquid (ink) particularly excellent in response characteristic.

As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination of the discharging orifice, liquid channel, and electricity-heat converter (linear liquid channel or right-angled liquid channel) as disclosed in the above-mentioned respective specification, the constitution by use of U.S. Pat. No. 4,558,333 or No. 4,459,600 disclosing the constitution having the heat acting portion arranged in the flexed region is also included in the present invention.

In addition, the present invention can be also effectively made like the constitution as disclosed in Japanese Laid-Open Patent Application No. 59-123670 which discloses the constitution using a slit common to a plurality of electricity-heat converters as the discharging portion of the electricity-heat converter or Japanese Laid-Open Patent Application No. 59-138461 which discloses the constitution having the opening for absorbing pressure waves of heat energy correspondent to the discharging portion.

In addition, as to the serial-type recording head as above described, the present invention is effective for a recording head of the freely exchangeable chip type which enables electrical connection to the main device or supply of ink from the main device by being mounted on the main device, or a recording head of the cartridge type having an ink tank integrally provided on the recording head itself.

Further, as the recording mode of the recording device, the present invention is extremely effective for not only the recording mode only of a primary color such as black etc., but also a device equipped with at least one of plural different colors or full color by color mixing, whether the recording head may be either integrally constituted or combined in plural number.

Though the ink is considered as the liquid in the examples of the present invention as described above, other types of ink are also sufficiently used if they stiffen below the room temperature and softens or liquefy at the room temperature, or liquefies when a recording enable signal is issued as it is commonly practiced in the ink jet system to control the viscosity of ink to be maintained within a certain range of stable discharge by adjusting the temperature of ink in the range from 30° C. to 70° C.

In addition, the ink having a property of liquefying only with application of heat energy is also applicable in the present invention, so that the ink will liquefy with the heat energy applied in accordance with a record signal so as to discharge liquid ink, or already begin to stiffen when arriving at recording medium, by using the ink which may prevent the temperature elevation with the heat energy by utilizing it positively as the energy for change of state from solid to liquid, or stiffen in the shelf state to avoid the evaporation of ink.

The most effective method for inks as above described in the present invention is one based on the film boiling as above indicated.

Furthermore, a recording apparatus according to the present invention can be in the form of being provided integrally or separately as an image output terminal in the information processing equipment such as a word processor or computer.

As above described, according to the present invention, it is possible to provide a recording apparatus with improved operativity capable of making the recording without operator's inconvenience, while shortening the total processing time from input by key to termination of recording.

What is claimed is:

1. An ink jet recording apparatus comprising:

key input means for inputting information;

moving means for moving in a predetermined direction a recording head for discharging ink to record onto a recording medium in accordance with said key input means;

protection means for protecting said recording head;

selection means for selecting between a word processor mode for printing the input information onto the recording medium in response to a print key and a typewriter mode for printing the input information on a basis of every predetermined unit of character of line;

discrimination means for discriminating whether a predetermined period has passed, while measuring a period after input by a key from said key input means, said discrimination means making a discrimination as to a passage of the predetermined period when in the typewriter mode; and execution means for carrying out protection of said recording head with said protection means based on a discrimination result by said discrimination means.

2. An ink jet recording apparatus according to claim 1, wherein a start or restart of measuring the predetermined period is performed at times of termination of printing and input by a key of said key input means.

3. An ink jet recording apparatus according to claim 1, further comprising driving means for generating heat energy for said recording head.

4. An ink jet recording apparatus according to any one of claim 1 to 3, wherein said ink jet recording apparatus comprises an electronic typewriter comprising means for displaying an original in a line print mode or a word print mode of the original displayed, and having a feature of being able to specify a recording area corresponding to the original.

5. An ink jet recording apparatus according to claim 1, wherein a length of the predetermined period is chanced in correspondence with a period obtained by measuring lengths of periods after a plurality of inputs by keys of said key input means.

6. An ink jet recording apparatus according to claim 5, wherein the length of the predetermined period is updated for every fixed number of inputs by keys of said key input means.

7. An ink jet recording apparatus according to claim 1, wherein the predetermined period is in a range from 3 to 8 seconds.

8. An ink jet recording apparatus comprising:

key input means for inputting information;

moving means for moving in a predetermined direction a recording head for discharging ink to record onto a recording medium in accordance with said key input means;

protection means for protecting said recording head;

discrimination means for discriminating whether a predetermined period has passed, while measuring a period after input by a key from said key input means; and execution means for carrying out protection by said recording head with said protection means based on a discrimination result of said discrimination means, said execution means changing a length of the predetermined period in accordance with a length of a period after an input by the key of said key input means, wherein the length of the predetermined period is updated for every fixed number of inputs by keys of said key input means.

9. An ink jet recording apparatus according to claim 8, wherein a start or restart of measuring the predetermined period is performed at a time of termination of printing and input by a key of said key input means.

10. An ink jet recording apparatus according to claim 8, further comprising driving means for generating heat energy for said recording head.

11. An ink jet recording apparatus according to any one of claims 8 to 10, wherein said ink jet recording apparatus comprises an electronic typewriter comprising means for displaying an original in a line print mode or a word print mode of the original displayed, and having a feature of being able to specify a recording area corresponding to the original.

12. An ink jet recording apparatus comprising:

key input means for inputting information;

moving means for moving in a predetermined direction in a recording head for discharging ink to record onto a recording medium in accordance with said key input means;

protection means for protecting said recording head;

selection means for selecting between a word processor mode for printing input information onto the recording medium in response to a print key and a typewriter mode for printing the input information on a basis of every predetermined unit of character or line;

discrimination means for discriminating whether a predetermined period has passed by measuring a period after an input by a key of said key input means, said discrimination means not discriminating whether the predetermined period has passed when in the word processor mode;

execution means for carrying out protection of said recording head with said protection means when said discriminating means discriminates that the predetermined period has passed; and changing means for changing a length of the predetermined period in accordance with a length of a period after the input by the key of said key input means.

13. An ink jet recording apparatus according to claim 12, wherein a start or restart of measuring the predetermined period is performed at times of termination of printing and input by a key of said key input means.

14. An ink jet recording apparatus according to claim 12, further comprising driving means for generating heat energy for said recording head.

15. An ink jet recording apparatus according to any one of claims 12 to 14, wherein said ink jet recording apparatus comprises an electronic typewriter comprising means for displaying an original in a line print mode or a word print mode of the original displayed, and having a feature of being able to specify a recording area corresponding to the original.

16. An ink jet recording apparatus according to claim 12, wherein the length of the predetermined period is updated for every fixed number of inputs by keys of said key input means.

17. An ink jet recording apparatus according to claim 12, wherein the predetermined period is in a range from 3 to 8 seconds.

18. An ink jet recording method using an ink jet recording apparatus for recording onto a recording medium by discharging ink through a discharge ports of a recording head using key inputting means for inputting information, the recording apparatus including a protecting means for protecting the recording head, said method comprising the steps of:

discriminating whether a recording mode is a word processor mode or a typewriter mode;

measuring a lapse of time from at least one key input by starting a timer for each of the at least one key input by the key inputting means when discriminated in said discriminating step that the recording mode is the typewriter mode; and protecting the recording head with the protection means when a measured result in said measuring step is greater than a predetermined time period.

19. An ink jet recording method according to claim 18, wherein recording is performed with heat energy being generated in electricity-heat converters provided in the recording head.

20. An ink jet recording method according to claim 18 or 19, wherein said ink jet recording method is applicable to an electronic typewriter and further includes the step of displaying an original in a line print mode or a word print mode of the original displayed, and the step of specifying a recording area corresponding to the original.

21. An ink jet recording apparatus having a key input device, and a carriage mechanism movable with a mounted recording head for recording an original by discharging ink onto a recording medium in accordance with information input by said key input device, said apparatus comprising:

protection means for protecting said recording head;

discrimination means for discriminating whether a predetermined period has passed by starting a measurement in accordance with an interruption of an input signal from said key input device;

control means for carrying out protection of said recording head with said protection means in accordance with a passage of the predetermined period discriminated by said discrimination means; and reset means for resetting said discrimination means in accordance with an input signal from said key input device.

22. An ink jet recording apparatus according to claim 21, wherein a start or restart of measurement by said discrimination means is performed at times of termination of printing and arrival of the input signal from said key input device.

23. An ink jet recording apparatus according to claim 21 or 22, further comprising driving means for generating heat energy for said recording head.

24. An ink jet recording apparatus according to claim 21 or 22, wherein said ink jet recording apparatus comprises an electronic typewriter comprising means for displaying the original in a line print mode or a word print mode of the original displayed, and having a feature of being able to specify a recording area corresponding to the original.

25. An ink jet recording apparatus according to claim 23, wherein said ink jet recording apparatus comprises an electronic typewriter comprising means for displaying the original in a line print mode or a word print mode of the original displayed, and having a feature of being able to specify a recording area corresponding to the original.

26. An ink jet recording apparatus having a key input device, and a carriage mechanism movable with a mounted recording head for recording an original by discharging ink onto a recording medium in accordance with information inputted by said key input device, said apparatus comprising:

protection means for protecting said recording head;

discrimination means for discriminating whether a predetermined period has passed by starting a measurement in accordance with an interruption of an input signal from said key input device;

control means for carrying out protection of said recording head with said protection means in accordance with passage of the predetermined period discriminated by said discrimination means;

reset mean for resetting said discrimination means in accordance with an input signal from said key input device;

means for switching between a word processor mode for printing the original in response to a print key, and a typewriter mode for printing the original on a basis of every predetermined unit of character or line; and means for inhibiting activation of said discrimination means when in the word processor mode.

27. An ink jet recording apparatus according to claim 26, wherein a start or restart of the measurement by said discrimination means is performed at times of termination of printing and arrival of an input signal from said key input device.

28. An ink jet recording apparatus according to claim 26 or 27, further comprising driving means for generating heat energy for said recording head.

29. An ink jet recording apparatus according to claim 26 or 27, wherein said ink jet recording apparatus comprises an electronic typewriter comprising means for displaying the original, and having a line print mode or a word print mode of the original displayed in the typewriter mode, and a feature of being able to specify a recording area corresponding to the original.

30. An ink jet recording apparatus according to claim 26, wherein said ink jet recording apparatus comprises an electronic typewriter comprising means for displaying the original, and having a line print mode or a word print mode of the original displayed in the typewriter mode, and a feature of being able to specify a recording area corresponding to the original.

31. An ink jet recording apparatus according to any one of claims 8, 21 and 26 wherein the predetermined period is in a range from 3 to 8 seconds.

32. An ink jet recording apparatus according to claim 7, wherein the predetermined period is more preferably 5 seconds.

33. An ink jet recording apparatus according to claim 12, wherein the predetermined period is more preferably 5 seconds.

34. An ink jet recording apparatus according to claim 8, 21 or 26, wherein the predetermined period is more preferably 5 seconds.

35. An ink jet recording method according to claim 18, wherein the protection means comprises a cap mechanism for covering an ink discharge port provided on the recording head for discharging ink.

36. An ink jet recording apparatus comprising:

key input means for inputting information;

moving means for moving in a predetermined direction a recording head for discharging ink to record onto a recording medium in accordance with said key input means;

protection means for protecting said recording head;

selection means for selecting between a word processor mode for printing the input information onto the recording medium in response to a print key and a typewriter mode for printing the input information on a basis of every predetermined unit of character or line;

discrimination means for discriminating whether a predetermined period has passed, while measuring a period after input by a key from said key input means; and execution means for carrying out protection of said recording head with said protection means based on a discrimination result by said discrimination means.

37. An ink jet recording apparatus according to claim 36, wherein a start or restart of measuring the predetermined period is performed at times of termination of printing and input by a key of said key input means.

38. An ink jet recording apparatus according to claim 36, further comprising driving means for generating heat energy for said recording head.

39. An ink jet recording apparatus according to any one of claim 36 to 38, wherein said ink jet recording apparatus comprises an electronic typewriter comprising means for displaying an original in a line print mode or a word print mode of the original displayed, and having a feature of being able to specify a recording area corresponding to the original.

40. An ink jet recording apparatus according to claim 36, wherein a length of the predetermined period is changed in correspondence with a period obtained by measuring lengths of periods after a plurality of inputs by keys of said key input means.

41. An ink jet recording apparatus according to claim 40, wherein the length of the predetermined period is updated for every fixed number of inputs by keys of said key input means.

42. An ink jet recording apparatus according to claim 36, wherein the predetermined period is in a range from 3 to 8 seconds.

43. An ink jet recording apparatus according to claim 36, wherein the predetermined period is more preferably 5 seconds.

44. An ink jet recording apparatus for recording onto a recording medium by discharging ink through a discharge port of a recording head using key inputting means for inputting information and protecting means for protecting the recording head, said apparatus comprising:

discrimination means for discriminating whether a recording mode is a word processor mode or a typewriter mode;

measuring means for measuring a lapse of time from at least one key input by starting a timer for each of the at least one key inputs by the key inputting means when discriminated by said discriminating means that the recording mode is the typewriter mode; and protecting means for protecting the recording head when a measured result by said measuring means is greater than a predetermined time period.

45. An ink jet recording apparatus according to claim 44, wherein recording is performed with heat energy being generated in electricity-heat converters provided in the recording head.

46. An ink jet recording apparatus according to claim 44 or 45, wherein said ink jet recording apparatus is applicable to an electronic typewriter and further comprises displaying means for displaying an original in a line print mode or a word print mode of the original displayed, and specifying means for specifying a recording area corresponding to the original.

47. An ink jet recording apparatus for recording onto a recording medium by discharging ink through a discharge port of a recording head using key inputting means for inputting information and protecting means for protecting the recording head, said apparatus comprising:

discrimination means for discriminating whether a recording mode is a word processor mode or a typewriter mode;

measuring means for measuring a lapse of time after an inputting operation by a predetermined key of the key inputting means when discriminated by said discriminating means that the recording mode is the typewriter mode; and protecting means for protecting the recording head when a measured result by said measuring means is greater than a predetermined time period.

48. An ink jet recording apparatus according to claim 47, wherein recording is performed with heat energy being generated in electricity-heat converters provided in the recording head.

49. An ink jet recording apparatus according to claim 47 or 48, wherein said ink jet recording apparatus is applicable to an electronic typewriter and further comprises displaying means for displaying an original in a line print mode or a word print mode of the original displayed, and specifying means for specifying a recording area corresponding to the original.

50. An ink jet recording apparatus according to claim 47, wherein the protection means comprises a cap mechanism for covering an ink discharge port provided on the recording head for discharging ink.

* * * * *

UNITED STATES PATENT AND TRADEMARK OFFICE

CERTIFICATE OF CORRECTION

PATENT NO. : 5,781,207

DATED : July 14, 1998

INVENTOR(S) : HASEGAWA, ET AL.

It is certified that error appears in the above-indentified patent and that said Letters Patent is hereby corrected as shown below:

On the title page, item

[56] References Cited:

FOREIGN PATENT DOCUMENTS, "0080066" should read --57-0080066--.

COLUMN 1:

Line 10, "Invention The" should read --Invention The--.

Line 41, "of" should read --of a--.

Line 61, "of cases." should read --case.--.

COLUMN 2:

Line 28, "to" should read --of--.

Line 58, "from" should read --from a--.

COLUMN 3:

Line 1, "of" should read --of the--.

Line 11, "of" should read --of the--.

Line 21, "(thereafter" should read --(hereafter--.

Lines 48 and 49 should be merged into the same paragraph.

UNITED STATES PATENT AND TRADEMARK OFFICE

CERTIFICATE OF CORRECTION

PATENT NO. : 5,781,207

DATED : July 14, 1998

INVENTOR(S) : HASEGAWA, ET AL.

It is certified that error appears in the above-indentified patent and that said Letters Patent is hereby corrected as shown below:

COLUMN 4:

Line 58, "If" should read --If the--.

COLUMN 5:

Line 25, "degradation" should read --the degradation--.

COLUMN 6:

Line 24, "(thereafter" should read --(hereafter--.

Line 25, "character character" should read --character by character-- and "(thereafter" should read --(hereafter--.

COLUMN 7:

Line 10, "If" should read --If the--.

Line 13, "If" should read --If the--.

Line 55, "previous" should read --previously--.

COLUMN 9:

Line 43, "softens" should read --soften--.

Line 44, "liquifies" should read --liquefy--.

UNITED STATES PATENT AND TRADEMARK OFFICE

CERTIFICATE OF CORRECTION

PATENT NO. : 5,781,207 Page 3 of 3

DATED : July 14, 1998

INVENTOR(S) : HASEGAWA, ET AL.

It is certified that error appears in the above-indentified patent and that said Letters Patent is hereby corrected as shown below:

COLUMN 10:

Line 36, "claim" should read --claims--.

Line 43, "chanced" should read --changed--.

COLUMN 12:

Line 3, "ports" should read --port--.

COLUMN 13:

Line 13, "mean" should read --means--.

Signed and Sealed this

Thirteenth Day of April, 1999

*Attest:*

Q. TODD DICKINSON

*Attesting Officer*

*Acting Commissioner of Patents and Trademarks*